United States Patent [19]

Cox et al.

[11] Patent Number: 4,551,580

[45] Date of Patent: Nov. 5, 1985

[54] TIME-FREQUENCY SCRAMBLER

[75] Inventors: Richard V. Cox, Piscataway; Nuggehally S. Jayant, Short Hills, both of N.J.

[73] Assignee: AT&T Bell Laboratories, Murray Hill, N.J.

[21] Appl. No.: 443,483

[22] Filed: Nov. 22, 1982

[51] Int. Cl.[4] ..... H04K 1/04

[52] U.S. Cl. ..... 179/1.5 S; 179/1.5 R; 178/22.04

[58] Field of Search ..... 179/1.5 R, 1.5 S; 178/22.04

[56] References Cited

U.S. PATENT DOCUMENTS

| | | | |
|---|---|---|---|
| 3,773,977 | 11/1973 | Guanella | 179/1.5 S |
| 3,970,790 | 6/1976 | Guanella | 179/1.5 S |
| 4,068,094 | 1/1978 | Schmid et al. | 179/1.5 S |
| 4,099,027 | 7/1978 | Whitten | 179/1.5 R |
| 4,149,035 | 4/1979 | Frutiger | 179/1.5 S |
| 4,221,931 | 9/1980 | Seiler | 179/1.5 S |
| 4,232,193 | 11/1980 | Gerard | 179/1.5 R |
| 4,266,095 | 5/1981 | McArdle | 179/1.5 R |
| 4,278,840 | 7/1981 | Morgan et al. | 179/1.5 S |
| 4,433,211 | 2/1984 | McCalmont et al. | 179/1.5 |
| 4,443,660 | 4/1984 | DeLong | 179/1.5 R |

OTHER PUBLICATIONS

Johnston, "A Filter Family Designed for Use in Quadrature Mirror Filter Banks," *Proceedings of* 1980 *International Conference of Acoustics, Speech and Signal Processing*, pp. 291–294, Apr. 1980.

MacKinnon, "The Development of Speech Encipherment," *The Radio and Electronic Engineer*, vol. 50, No. 4, pp. 147–155, Apr. 1980.

*Primary Examiner*—Salvatore Cangialosi

*Attorney, Agent, or Firm*—Kurt C. Olsen; Jack S. Cubert

[57] ABSTRACT

Subband signals are formed each corresponding to a portion of an input signal frequency spectrum. The subband signals are partitioned into subband time segments. The subband time segment signals are permuted. The permuted signals are combined to form a scrambled signal.

20 Claims, 6 Drawing Figures

| STEP | FROM INPUT BUFFER | KEY | TO OUTPUT BUFFER | PERMUTER BUFFER | | | | | |
|---|---|---|---|---|---|---|---|---|---|
| 0 | | | | 1 b(2,3) | 2 b(1,3) | 3 b(2,2) | 4 b(1,2) | 5 b(2,1) | 6 b(1,1) |
| 1 | b(1,4) | 3 | b(2,2) | 2 b(2,3) | 3 b(1,3) | 1 b(1,4) | 5 b(1,2) | 6 b(2,1) | 7 b(1,1) |
| 2 | b(2,4) | 1 | b(2,3) | 1 b(2,4) | 4 b(1,3) | 2 b(1,4) | 6 b(1,2) | 7 b(2,1) | 8 b(1,1) |
| 3 | b(1,5) | 5 | b(2,1) | 2 b(2,4) | 5 b(1,3) | 3 b(1,4) | 7 b(1,2) | 1 b(1,5) | 9 b(1,1) |
| 4 | b(2,5) | 4 | b(1,2) | 3 b(2,4) | 6 b(1,3) | 4 b(1,4) | 1 b(2,5) | 2 b(1,5) | 10 b(1,1) |
| 5 | b(1,6) | 4 | b(2,5) | 4 b(2,4) | 7 b(1,3) | 5 b(1,4) | 1 b(1,6) | 3 b(1,5) | 11 b(1,1) |
| 6 | b(2,6) | 6 | b(1,1) | 5 b(2,4) | 8 b(1,3) | 6 b(1,4) | 2 b(1,6) | 4 b(1,5) | 1 b(2,6) |

*FIG. 3*

| STEP | FROM INPUT BUFFER | RANK IN AGE | KEY | TO OUTPUT BUFFER | PERMUTER BUFFER | | | | | |
|---|---|---|---|---|---|---|---|---|---|---|
| 24 | b(2,15) | | 6 | | 8 / b(1,12) | 9 / b(2,11) | 4 / b(1,14) | 5 / b(2,13) | 2 / b(1,15) | 1 / b(2,15) |
| 25 | b(1,16) | 3 | 3 | b(1,14) | 9 / b(1,12) | 10 / b(2,11) | 1 / b(1,16) | 6 / b(2,13) | 3 / b(1,15) | 2 / b(2,15) |
| 26 | b(2,16) | 6 | 2 | b(2,11) | 10 / b(1,12) | 1 / b(2,16) | 2 / b(1,16) | 7 / b(2,13) | 4 / b(1,15) | 3 / b(2,15) |
| 27 | b(1,17) | 3 | 5 | b(1,15) | 11 / b(1,12) | 2 / b(2,16) | 3 / b(1,16) | 8 / b(2,13) | 1 / b(1,17) | 4 / b(2,15) |
| 28 | b(2,17) | 6 | 1 | b(1,12) | 1 / b(2,17) | 3 / b(2,16) | 4 / b(1,16) | 9 / b(2,13) | 2 / b(1,17) | 5 / b(2,15) |
| 29 | b(1,18) | 5 | 6 | b(2,15) | 2 / b(2,17) | 4 / b(2,16) | 5 / b(1,16) | 10 / b(2,13) | 3 / b(1,17) | 1 / b(1,18) |
| 30 | b(2,18) | 6 | 4 | b(2,13) | 3 / b(2,17) | 5 / b(2,16) | 6 / b(1,16) | 1 / b(2,18) | 4 / b(1,17) | 2 / b(1,18) |

*FIG. 4*

| STEP | FROM INPUT BUFFER | KEY | TO OUTPUT BUFFER | PERMUTER BUFFER | | | | | |
|---|---|---|---|---|---|---|---|---|---|
| 31 | b(1,19) | 6 | b(1,18) | 4 / b(2,17) | 6 / b(2,16) | 7 / b(1,16) | 2 / b(2,18) | 5 / b(1,17) | 1 / b(1,19) |
| 32 | b(2,19) | 5 | b(1,17) | 5 / b(2,17) | 7 / b(2,16) | 8 / b(1,16) | 3 / b(2,18) | 1 / b(2,19) | 2 / b(1,19) |
| 33 | b(1,20) | 4 | b(2,18) | 6 / b(2,17) | 8 / b(2,16) | 9 / b(1,16) | 1 / b(1,20) | 2 / b(2,19) | 3 / b(1,19) |
| 34 | b(2,20) | 3 | b(1,16) | 7 / b(2,17) | 9 / b(2,16) | 1 / b(2,20) | 2 / b(1,20) | 3 / b(2,19) | 4 / b(1,19) |
| 35 | b(1,21) | 2 | b(2,16) | 8 / b(2,17) | 1 / b(1,21) | 2 / b(2,20) | 3 / b(1,20) | 4 / b(2,19) | 5 / b(1,19) |
| 36 | b(2,21) | 1 | SYNC | 1 / b(2,21) | 2 / b(1,21) | 3 / b(2,20) | 4 / b(1,20) | 5 / b(2,19) | 6 / b(1,19) |

TIME-FREQUENCY SCRAMBLER

BACKGROUND OF THE INVENTION

This invention relates to communication privacy and more particularly, to scramblers that manipulate speech signals.

Speech scramblers are increasingly used for commercial as well as government communication. Digital scramblers have been developed in which a speech signal is encrypted and transmitted digitally. Conventional analog radio and telephone channels, however, cannot support the digital transmission rates required for high quality voice. Analog scramblers, those in which the final output of the scrambling process is an analog signal, therefore continue to be important.

In U.S. Pat. No. 4,278,840, issued to B. Morgan et al. on July 14, 1981, the speech spectrum is shifted within a predetermined band. The bandshifted signal is then divided into time segments. The time segments are permuted according to a pseudo-random process and transmitted. The Morgan disclosure illustrates a class of analog scramblers in which time and frequency operations occur in the tandem, that is, with one operation following the other. Although such tandem processes may have low residual intelligibility, they also may have, however, comparatively low cryptanalytical strength.

It is thus an object of the invention to provide an improved analog scrambler having enhanced cryptanalytical strength and low residual intelligibility.

SUMMARY OF THE INVENTION

The invention is directed to an arrangement for signal scrambling. An input signal is divided into subband signals corresponding to portions of the input signal frequency spectrum. Each subband signal is divided into time segments. The subband time segment signals are permuted. The permuted subband time segment signals are combined to form the scrambled signal.

BRIEF DESCRIPTION OF THE DRAWING

FIGS. 2, 3 and 4 show tables illustrative of the scrambling operations of the permuter in FIG. 1;

DETAILED DESCRIPTION

Figure 1:
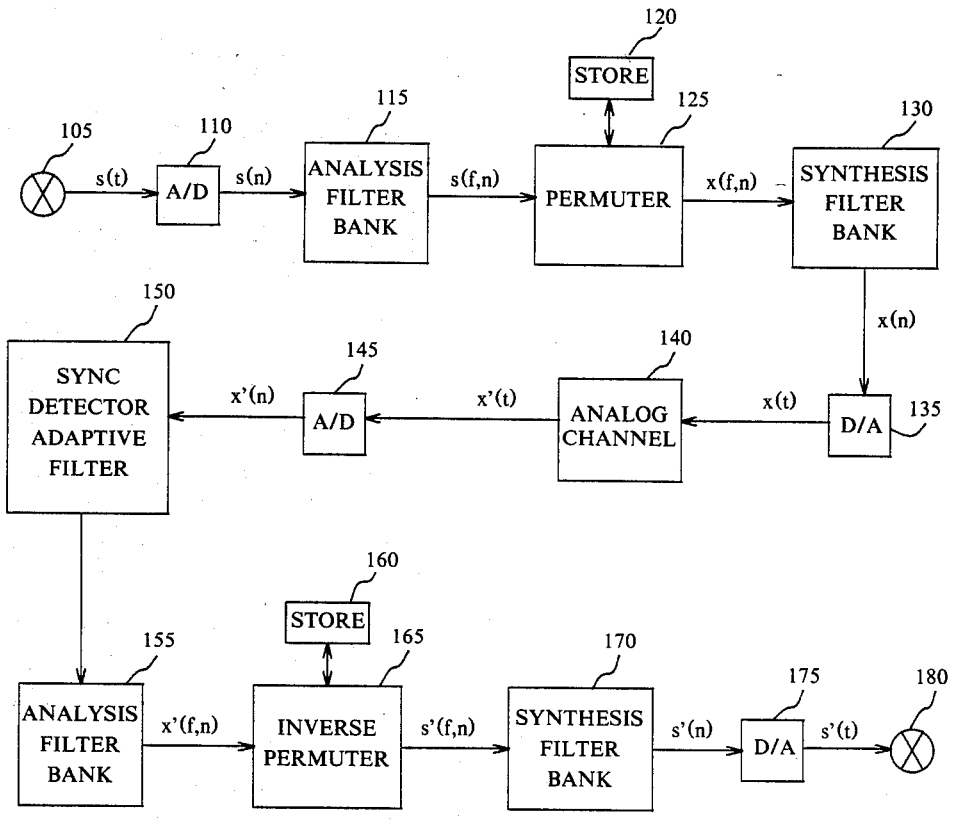
FIG. 1 shows a scrambler circuit illustrative of the invention.

FIG. 1 shows a general block diagram of a scrambling arrangement according to the invention. The system of FIG. 1 may be used for voice communication with privacy.

Referring to FIG. 1, the transmitter components of scrambler system 100 comprise input device 105, A/D (analog-to-digital) converter 110, analysis filter bank 115, store 120, permuter 125, synthesis filter bank 130 and D/A (digital-to-analog) converter 135. Analog signals, which are scrambled in both time and frequency, from converter 135 are transmitted via analog channel 140. The receiver portion of scrambler system 100 comprises A/D converter 145, sync detector and adaptive filter 150, analysis filter bank 155, store 160, inverse permuter 165, synthesis filter bank 170, D/A converter 175 and output device 180.

Converters 110, 135, 145 and 175 may be, for example, type M7062 integrated circuits made by Western Electric Company, Incorporated, New York, New York. Filter banks 115, 130, 155 and 170, and sync detector and adaptive filter 150 may be, for example, DSP integrated circuits made by Western Electric. These DSP circuits are described in a collection of articles entitled "Digital Signal Processor", *Bell System Technical Journal*, Vol. 60, No. 7, Part 2, September, 1981, pp. 1431–1809. Stores 120 and 160 may be, for example, type 218 integrated circuits made by Intel Corporation, Santa Clara, Calif. Permuter 125 and inverse permuter 165 may be, for example, type MC68000 integrated circuits made by Motorola, Incorporated, Phoenix, Ariz. Input device 105 and output device 180 may be, for example, microphone, telephone, voice storage or other communication equipment.

A speech signal s(t) is applied to converter 110. The sampling rate of converter 110 may be, for example, 8 kHz. The output of A/D converter 110 is a 12 bit, for example, digital representation signal s(n) of the amplitude of input speech signal s(t). The parenthetical n of digital input signal s(n) is an index which specifies a particular sample of the input speech signal s(t).

Digital sample signals s(n) from converter 110 are applied to analysis filter bank 115. Filter bank 115 is a digital filter bank adapted to produce digital sample signals of contiguous subbands of the speech signal and is preferably a quadrature mirror filter (QMF). A further description of QMF structures may be found in the article by J. D. Johnston entitled "A Filter Family Designed for Use in Quadrature Mirror Filter Banks," *Proceedings of* 1980 *International Conference of Acoustics, Speech and Signal Processing*, pp. 291–294, April 1980. Advantageously, the use of a digital filter bank incorporating the quadrature mirror filter improves the intelligibility of the decrypted signal by avoiding gaps in the frequency spectrum, substantially eliminates noise caused by the smoothing of time segment ends due to filter transition bandwidth, and improves the cryptological strength of the scrambling by permitting time segments as short as one sample period.

Filter bank 115 splits digital sample signal s(n) into a plurality of subband signals s(f,n). Index n specifies the time index of a sample. Index f specifies a particular subband where the range of f equals 1, 2, . . . F. The total number of subbands F depends on the application. For full duplex telephone transmission, there are preferably F=3 bands: s(1,n) is the 0–500 Hz band, s(2,n) is the 500–1000 Hz band, and s(3,n) is the 2000–2500 Hz band. For half duplex telephone transmission, there are preferably F=5 bands: s(1,n) is the 0–500 Hz band, s(2,n) is the 500–1000 Hz band, s(3,n) is the 1000–1500 Hz band, s(4,n) is the 1500–2000 Hz band and s(5,n) is the 2000–2500 Hz band.

The subband sample signals s(f,n) are applied to time and frequency permuter 125. Permuter 125 may be controlled according to a microcode program in store 120. In permuter 125, the sample signals s(f,n) in each subband are grouped into blocks. Each block may consist of, for example, 5 samples. According to the invention, the blocks are permuted, that is, the order of the blocks is changed. Since each block represents a segment of speech in a particular frequency subband at a particular interval in time, the speech signal corresponding to a sequence of the permuted blocks is scrambled in both the time and frequency domains simultaneously. In prior scramblers, such as described in Morgan, the time and frequency manipulations are independent or sequential.

Scrambled subband sample signals x(f,n) are formed from the permuted blocks in permuter 125. A synchronization signal may be substituted periodically for one of the scrambled subband sample signals. The scrambled signals x(f,n) are applied to synthesis filter bank 130. For full duplex telephone transmission, the three subbands are combined into either a 500–2000 kHz band or a 2000–3500 kHz band. In full duplex operation, two persons may use the system simultaneously. Each user, therefore, gets one of the available bands. In the half duplex system the five subbands are combined into a 500–3000 Hz band. The combined scrambled signal x(n) from filter bank 130 is applied to D/A converter 135. The encrypted analog output signal x(t) from converter 135 is applied to analog channel 140 for transmission.

The received encrypted signal x'(t) from channel 140 is sampled and converted to digital form in A/D converter 145. The received digital sample signal x'(n) is applied to sync detector and adaptive filter 150. Responsive to the detection of the synchronization signal in detector and filter 150, the received digital signal x'(n) and the transmitted digital signal x(n) are synchronized in time. Other signal processing, such as equalization and phase roll compensation, well known in the art, may also be performed. The received digital signal x'(n) is then applied to analysis filter bank 155. In filter bank 155, signal x'(n) is split into three or five subband sample signals x'(f,n), depending on whether the system is full or half duplex.

The subband signals x'(f,n) are assembled into blocks in inverse permuter 165. Inverse permuter 165 may be controlled according to a microcode program in store 160. The blocks are descrambled, that is, the blocks are reordered according to their original time and frequency relationships. Descrambled subband sample signals s'(f,n) are formed from the descrambled blocks in inverse permuter 165. The descrambled signals s'(f,n) from inverse permuter 165 are combined in synthesis filter bank 170. The combined digital signals s'(n) are converted to analog form in D/A converter 175. The analog output signal s'(t) from converter 175 is applied to output device 180. Output signal s'(t) is an intelligible replica of the original signal s(t).

Sample-to-sample integrity must be maintained between the transmitter and the receiver if the final output signal s'(t) is to be a good quality replica of the input signal s(t). In other words, for each sample n, the received signal x'(n) should correspond to the transmitted signal x(n). An ideal channel by definition meets this requirement. In a real environment such as radio or telephone communication, however, variable delays are introduced which may disrupt sample-to-sample correspondence between the transmitter and receiver.

The solution according to the invention is to substitute a synchronization signal in lieu of one of the blocks in a predetermined group of blocks. The synchronization signal is inserted at the end of one cycle of the scrambling process, that is, when one group of blocks has been permuted. For the next group, the scrambling process starts over again at its first step.

Responsive to the detection of the sync pulse in the receiver, the descrambling process in inverse permuter 165 is likewise reset to its first step. Since the scrambling process repeats periodically, any mismatch between samples in the transmitter and receiver is corrected quickly and degradation of the output signal is minimized.

In order to minimize signal degradation due to the sync pulse itself, the pulse is preferably substituted for a block of samples in the highest frequency subband s(f,n). In the full and half duplex examples, the highest frequency subbands are s(3,n) and s(5,n), respectively.

Turning now to detailed consideration of the scrambling process, it will be recalled that a block may comprise, for example, 5 samples. The blocks b(f,m) are assembled at an input buffer of the microprocessor in permuter 125. Index f in b(f,m) specifies a particular subband, the same one as in s(f,n). Index m specifies the block number. For instance, the first block in the lowest subband, block b(1,1), consists of samples s(1,1), s(1,2), s(1,3), s(1,4) and s(1,5) from filter bank 115. The first block in the next highest subband b(2,1), consists of samples s(2,1), s(2,2), s(2,3), s(2,4) and s(2,5). In addition to the input buffer, the microprocessor in permuter 125 also includes a permuter buffer and an output buffer which are used in the scrambling process.

The scrambling process consists of a series of steps. At each step, one block from a specified memory location or address in the permuter buffer is sent to the output buffer. A block from the input buffer is then sent to the same permuter buffer memory location. The memory location is specified by one of the entries in a "key".

The key is a list of addresses which correspond to permuter buffer memory locations. The list may be saved at store 120 of FIG. 1. There is one entry in the key for each step in the permuting process. A key entry specifies which permuter buffer memory location will be used at the corresponding step. The entries are selected at random, subject to constraints discussed below.

It is important to understand that a particular key is determined once and saved permanently in store 120 of FIG. 1. Thus, in real time, continuous operation of scrambler 100, the same key is used over and over again as the finite number of steps in the scrambling process is repeated. At the end of each cycle in the scrambling process, the synchronizing signal is transmitted, signifying that the process is about to begin again.

FIGS. 2, 3 and 4 show how permuter buffer addresses comprising a particular key may be determined. A table of selected steps in the scrambling process is given. The condition of the permuter buffer at the end of each step is also represented. Each buffer representation is divided with vertical lines into six squares. The leftmost square corresponds to permuter buffer memory location or address 1. The next square to the right is memory location 2. The rightmost square is memory location 6. In each square, the block b(f,m) loaded at the corresponding permuter buffer memory location is shown.

The age of a block is a count of the number of steps that the block has resided in the permuter buffer. The block age is shown in the diagonally divided corner at the upper right of each square. (Note that the addresses of permuter buffer memory locations are not shown because they are the same in all steps.)

For illustration in FIGS. 2, 3 and 4, there are a total of F=2 subbands. The key consists of K=36 entries corresponding to permuter buffer addresses. The input, permuter and output buffers each hold B=6 blocks. In actual practice, there may be, for example, F=3 or 5 subbands, a key length of K=300 entries, and a buffer size of NB=15 blocks.

The initial state of the permuter buffer is defined by the conditions shown at step 0 in FIG. 2. The ages of the blocks ascend in order from left to right. In addition, the age of each block is the same as the address of the permuter buffer memory location where the block resides. The first block in the low subband, block b(1,1), has an age of 6 and resides at memory location 6. The first block in the high subband, block b(2,1), has an age of 5 and resides at memory location 5. The third block in the high subband, block b(2,3), has an age of 1 and resides at memory location 1.

In step 1, the fourth block in the low subband, block b(1,4), is input from the input buffer to the permuter buffer. The key specifies which memory location in the permuter buffer the input block b(1,4) is to be entered. The key may be any number selected at random between 1 and 6, since there are 6 possible buffer locations. In step 1, the selected key is 3. The present contents of memory location 3 in the permuter buffer, block b(2,2), is therefore sent to the output buffer, making room for block b(1,4) from the input buffer. The drawing at step 1 shows the condition of the permuter buffer after block b(1,4) has been entered. Since block b(1,4) is the newest block, its age is 1. The ages of all other blocks are incremented by 1 from step 0 to step 1.

In step 2, the fourth block in the high subband, block b(2,4), is input from the input buffer to the permuter buffer. The key, again selected at random between 1 and 6, is 1. The contents of permuter memory location 1, block b(2,3), is therefore sent to the output buffer. Block b(2,4) is then entered into location 1 with an age of 1. The ages of all other blocks in the permuter buffer are incremented by 1.

In order to limit the total communication delay inuring to the scrambling process, a maximum permissible age of the oldest block in the permuter buffer may be established. In accordance with the invention, it is preferable that the maximum time t (in multiples of block duration) that a block may stay in the permuter buffer is equal to twice the size of the permuter buffer:

$$t=2N-1 \quad (1)$$

Referring to step 5 in FIG. 2, it is seen that the oldest block, block b(1,1), has an age of 11. Thus at step 6, block b(1,1) must be released to the output buffer. Since the block to be released is in the sixth memory location of the permuter buffer, the key at step 6 is also 6.

For steps 7–23 (not shown), the key is selected in the same way as in the preceding steps: at any particular step, the key is chosen to release a block which has reached the maximum age; if no block has reached the maximum age, the key is picked randomly. This process is advantageous from the viewpoint of cryptanalytic strength and residual intelligibility because every block has an equal probability of spending the maximum time in the permuter buffer.

It will be recalled that to accomplish synchronization between the transmitter and receiver, the permuter buffer must be returned to its initial state. Additional constraints are therefore applied to the selection of each key for the last 2NB−1 steps in the key sequence. In the present example, there are 36 steps in the key sequence and the permuter buffer has a length NB=6. Constraints on the selection of the key therefore are applied beginning at step 26.

Referring to FIG. 3, at step 26, the key must be chosen so that one of the five oldest blocks is sent to the output buffer. The selection of a key equal to 2 at step 26 sends block b(2,11) to the output buffer. As shown in the permuter buffer representation at step 25, block b(2,11) has an age of 10. Block b(2,11) is also the sixth oldest of the six blocks in the permuter buffer. Its relative age or "rank in age", as shown at step 26, is thus 6. The constraint on the key at step 26 may be expressed equivalently as the rank in age must be greater than or equal to 2 (and, as always in this example, less than or equal to 6).

At step 27, the rank in age of the block sent to the output buffer must be greater than or equal to 3. The key may therefore correspond to the permuter memory location of any of the four oldest blocks. The key of 5 shown at step 27 corresponds to the location of block b(1,15), which has a rank in age of 3.

At step 28, the rank in age must be greater than or equal to 4 and the key must therefore correspond to either of the three oldest blocks. It may be seen, however, that block b(1,12) reached the maximum age of 11 in step 27. Block b(1,12) therefore must be released to the output buffer at step 28 instead any of the other otherwise permissible blocks. The key is thus 1 and the rank in age of block b(1,12) is 6.

At step 29, only the oldest and next oldest blocks are eligible for the output buffer, that is, the rank in age must be greater than or equal to five. At step 30, the oldest block, block b(2,13), having a rank in age of 6, must be sent to the output buffer.

Referring to FIG. 4, the key is constrained to descend in sequence from 6 to 1 at steps 31 to 36, respectively. At the end of step 36, the permuter buffer is in the initial state, that is, the ages of the block ascend in order from left to right and are the same as the addresses of the corresponding memory locations. In lieu of the contents of permuter buffer location 1 (block b(2,17), as shown at step 35), a sync signal is applied to the output buffer.

A program for generating a permuter key in accordance with the preceding constraints is listed in FORTRAN language form in Appendix A. The equivalent representation of a key generated by the program may be kept permanently in microcode form in store 120.

The preceding description concerned the generation of a key useful for block scrambling in permuter 125 of FIG. 1. In order to descramble the blocks in inverse permuter 165, an inverse key must be determined. Like the permuter key, a particular inverse permuter key is determined once and is saved permanently in store 160. The inverse permuter key is used over and over again in continuous operation of the inverse permuter. Each time the synchronizing signal is detected in the inverse permuter, the descrambling process restarts at its first step.

The construction of the inverse permuter key is straightforward given the permuter key. In a typical embodiment, inverse permuter 165 comprises the same elements as permuter 125: a microprocessor having input and output buffers, and an inverse permuter buffer of the same length NB. The inverse key sequence thereby has the same number of steps as the original key sequence. The age of each block in the inverse permuter buffer is equal to its age when released from the permuter buffer plus the time it has spent in the inverse permuter buffer. At each step in the inverse permuter, the key is selected to send the oldest block in the inverse permuter buffer to the output buffer. The output buffer thereby contains blocks b(f,m) descrambled in time and frequency.

The primary purpose of FIGS. 2, 3 and 4 is to illustrate the one-time generation of a permuter key. These figures also illustrate one cycle of the scrambling process. Since there are 36 steps in one cycle of the process, each group of 36 blocks will be rearranged or permuted in the same way.

Figure 5:
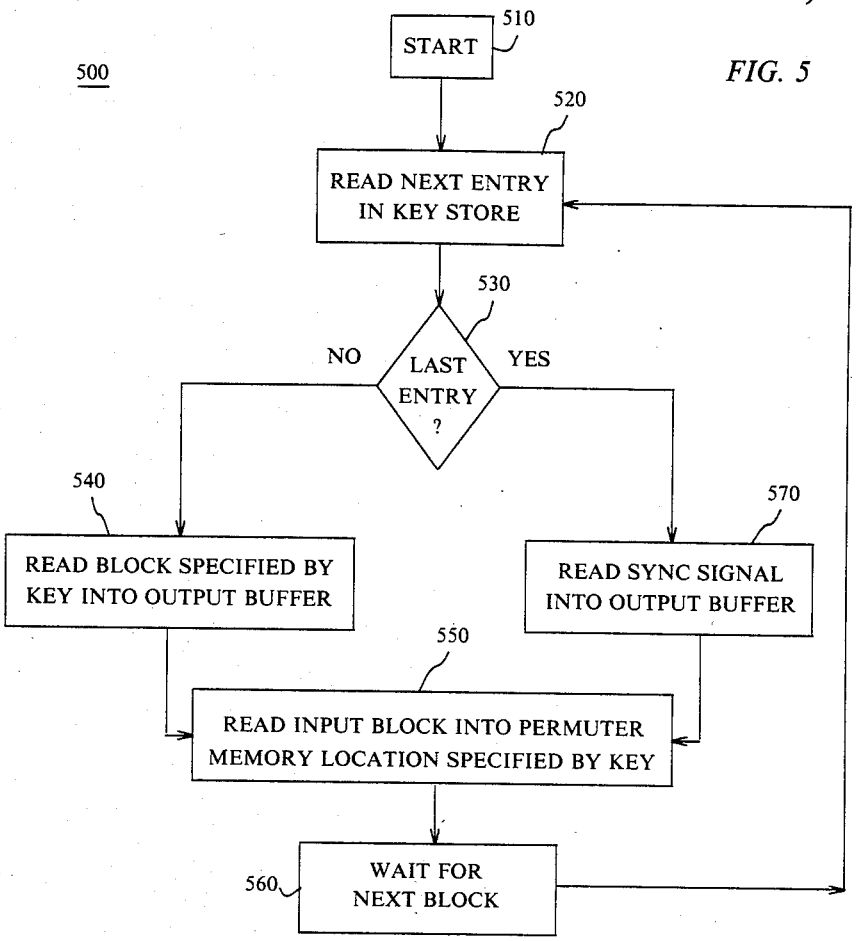
FIG. 5 shows a flowchart of scrambling operations in the permuter of FIG. 1.

Referring to FIG. 5, the overall scrambling process in the permuter is shown by flowchart 500. The scrambling process starts with the permuter buffer in the initial state (box 510). At step 1, the key is read from the key store 120 (box 520). Since step 1 is not the last step (box 530), the block b(f,m) specified by the key is read from the permuter buffer and sent to the output buffer (box 540). The block from the input buffer is read into the permuter buffer memory location specified by the key (box 550). The permuter then waits for the next block to be formed in the input buffer (box 560). At the next step, the next entry is read from the key store (box 520). The process continues repetitively for the succeeding steps until the last entry in the key sequence is reached (box 530). The sync signal is then applied to the output buffer (box 570). The input block at the last step is read (box 550) and the permuter buffer is thereby reinitialized. The scrambling cycle then restarts at its first step. A FORTRAN program for controlling the permuter in accordance with flowchart 500 is listed in Appendix B. A microcode version of the program may reside in store 120.

Figure 6:
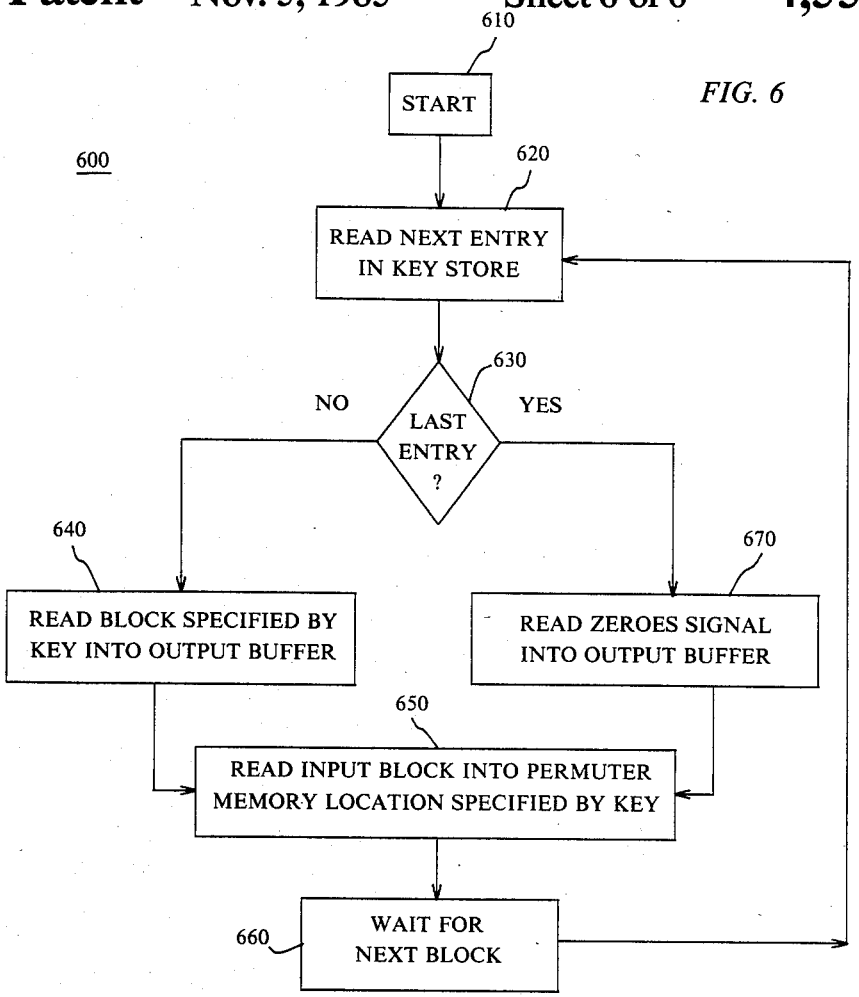
FIG. 6 shows a flowchart of descrambling operations in the inverse permuter of FIG. 1.

Referring to FIG. 6, the overall descrambling process in the inverse permuter is shown by flowchart 600. Descrambling begins with the inverse permuter buffer in the initial state (box 610). The inverse key is read from key store 160 (box 620). If the inverse key is not the last entry (box 630), the block from the inverse permuter buffer memory location specified by the inverse key is applied to the output buffer (box 640). The block from the input buffer is sent to the buffer location vacated by the block sent to output buffer (box 650). The inverse permuter then waits for the next block to be formed in the input buffer (box 660) and the process repeats. At the last entry in the key sequence (box 630), zeroes are read into the output buffer (box 670). Zeroes cause an imperceptible silence in place of the sync signal. The descrambling cycle then restarts at its first step.

Although the invention has been shown and described with reference to preferred embodiments, various modifications may be made without departing from the spirit and scope of the invention. For example, the block permuting key may be changed periodically in a manner known to both the transmitter and receiver, that is, in accordance with a super-key.

APPENDIX A

```
C       *** KEYGEN ***
C       A PROGRAM TO PRODUCE A KEY FOR THE
        PERMUTER COMMON /PARMS/ IAGE(128),
        IAGEMX,NB
C       NB IS NO. OF BLOCKS IN BUFFER
C       IAGEMX IS MAX AGE AT WHICH BLOCKS MUST
C       BE SELECTED FOR TRANSMISSION
C       IAGE KEEPS TRACK OF AGE OF BLOCKS
        DIMENSION INFIL(10)
        WRITE (10,1001)
1001    FORMAT("ENTER NAME FOR KEY: ",Z)
        READ (11,1000) INFIL(1)
1000    FORMAT(S19)
        OPEN 2, INFIL
C       INITIALIZATION
        ACCEPT "ENTER NUMBER OF BLOCKS IN
```

APPENDIX A-continued

```
        BUFFER: ",NB
        IAGEMX=2*NB-1
        DO 21 I=1,NB
21      IAGE(I)=I-1
        ACCEPT "ENTER THE LENGTH OF THE KEY:
        ",NKEY LNB=NKEY-2*NB
C       DO FIRST NKEY-2*NB ENTREES IN THE KEY
        DO 100 JJJ=1,LNB
C       UPDATE AGES OF BLOCKS
        DO 1 I=1,NB
1       IAGE(I)=IAGE(I)+1
C       NOW CHECK FOR OLDEST BLOCK'S AGE
        IFLAG=-1
        I=1
2       IF(IAGE(I).EQ.IAGEMX) GO TO 3
        IF(I.EQ.NB) GO TO 4
        I=I+1
        GO TO 2
3       IFLAG=I
C       BLOCK I MUST EXIT DUE TO ITS AGE
        GO TO 5
4       ZZZ=RNGEN(ZZZ)
C       RNGEN IS A RANDOM NUMBER GENERATOR
        WHICH YIELDS 0<ZZZ<1
        IFLAG=1+INT(NB*ZZZ)
5       IAGE(IFLAG)=0
100     WRITE BINARY (2) IFLAG
C       PICK OLDEST BLOCK, FIRST STEP IN BRINGING
C       BUFFER TO ORIGINAL STATUS
        DO 200 JJJ=1,NB
        DO 101 I=1,NB
101     IAGE(I)=IAGE(I)+1
        IOLD=IAGE(1)
        IFLAG=1
        DO 102 I=2,NB
        IF(IAGE(I).LT.IOLD) GO TO 102
        IOLD=IAGE(I)
        IFLAG=I
102     CONTINUE
200     WRITE BINARY (2) IFLAG
C       NOW PICK BLOCKS IN REVERSE ORDER, FINAL
C       STEP TO RESTORING STATUS
        DO 300 JJJ=1,NB
        IFLAG=1+NB-I
300     WRITE BINARY (2) IFLAG
        CLOSE 2
        STOP
        END
```

APPENDIX B

```
C       *** PERMUTER ***
C       SUBROUTINE THAT DOES PERMUTING FOR
        TRANSMITTER
C       THIS SUBROUTINE IS FOR ANY NUMBER OF
        BANDS
C       IT DOES THE PERMUTATION ONE BLOCK AT A
        TIME
C       X IS AN INPUT BLOCK, Y IS AN OUTPUT BLOCK
        SUBROUTINE PERMUTER(X,Y)
        COMMON /SCRAM/ BUFFER(256),KEY(0:299),
        NKEY,JKEY,NB
C       BUFFER IS THE PERMUTER MEMORY FOR THE
        DATA
C       KEY IS THE STORED KEY
C       NKEY IS THE LENGTH OF THE KEY
C       JKEY IS THE MOST RECENT KEY ENTRY READ
C       NB IS THE NUMBER OF BLOCKS IN THE BUFFER
        COMMON /LCNTS/ MCNT,IPNT
C       MCNT IS THE LENGTH OF A BLOCK
C       IPNT IS THE POINTER
        DIMENSION X(1),Y(1)
C       READ NEW KEY AND SET POINTER
        JKEY=MOD(1+JKEY,NKEY)
        NEWKEY=KEY(JKEY)
        IPNT=MCNT*(NEWKEY-1)+1
C       NOW DO THE ACTUAL PERMUTING
        DO 20 I=1,MCNT
C       CHECK TO SEE IF SYNC SIGNAL SHOULD BE SENT
        IF(JKEY.EQ.NKEY-1) Y(I)=BUFFER(I+MCNT*NB)
        IF(JKEY.NE.NKEY-1) Y(I)=BUFFER(IPNT)
```

APPENDIX B-continued

```
BUFFER(IPNT)=X(I)
IPNT=IPNT+1
RETURN
END
```

What is claimed is:

1. Apparatus for scrambling an analog signal comprising:

means for sampling the analog signal at a predetermined rate to develop digital sample signals corresponding to the analog signal;

means responsive to the digital sample signals for digitally forming a plurality of contiguous subband digital sample signals, said contiguous subbands extending over a prescribed portion of the frequency spectrum of the analog signal spectrum;

means for partitioning the digital sample signals of each subband into digital signal blocks;

means for permuting the digital signal blocks of a predetermined group of blocks;

means for digitally combining the permuted subband digital signal blocks into a single band digitally samples signal; and means responsive to said combined permuted single band digitally signal block sample signals for forming a scrambled analog signal.

2. Apparatus as in claim 1 wherein said permuting means comprises:

means for successively selecting groups of the digital signal blocks;

input, output and permuter buffers;

means for storing a predetermined number of address signals corresponding to the sequence of locations in said permuter buffer;

means for applying the signal blocks to the input buffer; and means responsive to each stored address signal for applying the contents of the corresponding permuter buffer location to the output buffer and for applying a signal block from the input buffer to the same permuter buffer location.

3. Apparatus as in claim 2 wherein the means for applying the contents of the permuter buffer to the output buffer comprises:

means for substituting a synchronization signal for at least one of the subband signal blocks in each group.

4. Apparatus as in claim 3 wherein the means for substituting a synchronization signal comprises means for replacing a signal blocks signal which corresponds to the highest subband portion of the input signal frequency spectrum with a prescribed signal.

5. Apparatus as in claim 1 wherein said contiguous subband sampling signal forming means comprises a first quadrature mirror filter and said permuted digital signal block combining means comprises a second quadrature mirror filter.

6. Apparatus for descrambling a received signal comprising:

means for sampling the received signal to develop digital sample signals corresponding thereto;

means responsive to said digital sample signals for digitally forming contiguous subband digital sample signals, said contiguous subbands covering a prescribed portion of the received signal frequency spectrum;

means responsive to the subband sample signals for forming subband digital signal blocks;

means for inverse permuting predetermined groups of said subband digital signal blocks;

means for digitally combining the inverse permuted subband signal blocks to form a single band descrambled digitally sampled signal; and means for converting the single band descrambled digitally sampled signal into an analog signal.

7. Apparatus as in claim 6 wherein said inverse permuting means comprises:

input, output and inverse permuter buffers;

means for storing a predetermined number of address signals corresponding to a sequence of locations in the inverse permuter buffer;

means for applying signal blocks to the input buffer;

means responsive to each stored address signal for applying the contents of the corresponding inverse permuter buffer location to the output buffer and for applying a signal block from the input buffer to the same inverse permuter buffer location.

8. Apparatus as in claim 7 wherein the means for applying the contents of the inverse permuter buffer to the output buffer comprises:

means for substituting a silent signal for at least one of the subband signal blocks in each group.

9. Apparatus as in claim 8 wherein the means for substituting a silent signal comprises:

means for replacing a subband time segment signal which corresponds to the highest subband portion of the received signal frequency spectrum with a prescribed signal.

10. Apparatus as in claim 6 wherein the subband sample signal forming means and the inverse permuted block combining means each comprise a quadrature mirror filter.

11. A method for scrambling an input signal comprising the steps of:

sampling the input signal to develop digital sample signals corresponding thereto;

responsive to the digital sample signals, digitally forming a plurality of contiguous subband digital sample signals, said contiguous subbands covering a prescribed frequency portion of the input signal spectrum;

partitioning the digital sample signals of each subband into digital signal blocks;

permuting the digital signal blocks of a predetermined group of blocks;

digitally combining the permuted subband signal blocks into a single band digital sampled signal; and forming a scrambled analog signal responsive to the single band digital sampled signal.

12. The method of claim 11 wherein the permuting of the signal blocks comprises:

selecting successive groups of the signal blocks;

storing a predetermined number of address signals corresponding to a sequence of locations in a permuter buffer;

applying the signal blocks to an input buffer; and responsive to each stored address signal, applying the contents of the corresponding permuter buffer location to the output buffer and applying a signal block from the input buffer to the corresponding permuter buffer location.

13. The method of claim 12 wherein the step for applying the contents of the permuter buffer to the output buffer comprises:

substituting a synchronization signal for at least one of the subband signal blocks in each group.

14. The method of claim 13 wherein the step for substituting a synchronization signal comprises:

replacing a subband signal block which corresponds to the highest subband portion of the input signal frequency spectrum with a prescribed signal.

15. The method of claim 11 wherein the subband sample signal forming step comprises applying the digital sample signals to a quadrature mirror filter and the permuted block combining step comprises applying the permuted digital signal blocks to a quadrature mirror filter.

16. A method for descrambling a received signal comprising the steps of:

sampling the received signal to develop digital sample signals corresponding thereto;

forming a plurality of contiguous subband sample signals responsive to said digital sample signals, each subband corresponding to a predetermined portion of the received signal spectrum;

partitioning the digital sample signals of each subband into a sequence of digital signal blocks;

inverse permuting a predetermined group of subband digital signal blocks;

digitally combining the inverse permuted subband digital signal blocks to form a single band descrambled digitally samples signal; and converting said descrambled single band digitally sampled signal into an analog signal.

17. The method according to claim 16 wherein the inverse permuting step comprises:

selecting successive groups of the subband digital blocks;

storing a predetermined number of address signals corresponding to the sequence of locations in an inverse permuter buffer;

applying the digital signal blocks to an input buffer; and applying responsive to each stored address signal the contents of the corresponding inverse permuter buffer location to the output buffer and a subband digital signal block from the input buffer to the same inverse permuter buffer location.

18. The method of claim 17 wherein the step for applying the contents of the inverse permuter buffer to the output buffer comprises:

substituting a silent signal for at least one of the subband digital signal blocks in each group.

19. The method of claim 18 wherein the step for substituting a silent signal comprises:

replacing a subband digital signal block which corresponds to the highest subband portion of the received signal frequency spectrum with a prescribed signal.

20. The method of claim 16 wherein the subband sample signal forming step comprises applying the digital sample signals to a quadrature mirror filter and the inverse permuted block combining step comprises applying the inverse permuted digital signal blocks to a quadrature mirror filter.

* * * * *

UNITED STATES PATENT AND TRADEMARK OFFICE

CERTIFICATE OF CORRECTION

PATENT NO. : 4,551,580

DATED : November 5, 1985

INVENTOR(S) : Richard V. Cox and Nuggehally S. Jayant

It is certified that error appears in the above-identified patent and that said Letters Patent is hereby corrected as shown below:

Column 9, line 25, "samples" should read --sampled--; line 53, "replacing a" should read --replacing--, "signal blocks signal" should read --subband signal blocks--.

Signed and Sealed this

Twentieth Day of January, 1987

*Attest:*

DONALD J. QUIGG

*Attesting Officer*

*Commissioner of Patents and Trademarks*